US012698140B2

(12) United States Patent
Bellmore

(10) Patent No.: US 12,698,140 B2
(45) Date of Patent: Aug. 4, 2026

(54) RECYCLABLE FILM FOR A POUCH AND A POUCH ASSEMBLY

(71) Applicant: SIG Combibloc Services AG, Neuhausen am Rheinfall (CH)

(72) Inventor: David Bellmore, Bellaire, MI (US)

(73) Assignee: SIG COMBIBLOC SERVICES AG, Neuhausen am Rheinfall (CH)

( * ) Notice: Subject to any disclaimer, the term of this patent is extended or adjusted under 35 U.S.C. 154(b) by 258 days.

(21) Appl. No.: 18/123,248

(22) Filed: Mar. 17, 2023

(65) Prior Publication Data

US 2024/0308740 A1 Sep. 19, 2024

(51) Int. Cl.

| | |
|---|---|
| ***B65D 65/40*** | (2006.01) |
| ***B65D 41/04*** | (2006.01) |
| ***B65D 75/00*** | (2006.01) |
| ***B65D 75/58*** | (2006.01) |

(52) U.S. Cl.

CPC ..... *B65D 65/40* (2013.01); *B65D 75/008* (2013.01); *B65D 75/5883* (2013.01); *B65D 41/04* (2013.01); *B65D 2207/00* (2013.01); *B65D 2565/385* (2013.01); *B65D 2565/387* (2013.01)

(58) Field of Classification Search

None

See application file for complete search history.

(56) References Cited

U.S. PATENT DOCUMENTS

| | | | | |
|---|---|---|---|---|
| 2005/0109796 | A1* | 5/2005 | Bourque | B65D 75/008 222/129 |
| 2016/0229157 | A1 | 8/2016 | Clare | |
| 2020/0115129 | A1* | 4/2020 | Daering | B65D 75/008 |
| 2023/0142282 | A1* | 5/2023 | Lee | B32B 27/308 428/213 |

FOREIGN PATENT DOCUMENTS

| | | | |
|---|---|---|---|
| WO | 2019172932 | A1 | 9/2019 |

* cited by examiner

*Primary Examiner* — Ramsey Zacharia

(74) *Attorney, Agent, or Firm* — The Watson IP Group; Jovan N. Jovanovic

(57) ABSTRACT

A film for a pouch having a central layer, a first LLDPE tie layer, a second LLDPE tie layer, an outside HDPE layer, and inside HDPE layer and an inner LLDPE layer. The central layer is an ethylene EVOH, having an inside and an outside opposite the inside and a thickness. The first LLDPE tie layer is on the inside of the EVOH. The second LLDPE tie layer is on the outside of the EVOH. The at least one outside HDPE layer on an outside of the second LLDPE tie layer opposite the EVOH layer. The at least one inside HDPE layer on an inside of the first LLDPE tie layer opposite the EVOH layer. The inner LLDPE layer on an innermost of the at least one inside HDPE layer. The inside PE thickness being at least twice the outside PE thickness.

16 Claims, 3 Drawing Sheets

RECYCLABLE FILM FOR A POUCH AND A POUCH ASSEMBLY

CROSS-REFERENCE TO RELATED APPLICATION

N/A

BACKGROUND OF THE DISCLOSURE

1. Field of the Disclosure

The disclosure relates in general to packaging, and more particularly, to a recyclable film for a pouch and a pouch assembly formed from a recyclable film.

2. Background Art

The use of flexible packaging is well known in the art. Among other types of packaging, one common type of packaging is a pouch filled with a flowable material. Such pouches typically have a spout that is sealed between two layers which form the body of the pouch. Such pouches may further be gusseted or may include a lower gusset opposite the spout or space away from the spout.

Such pouches are typically made from polyethylene based films. Such films, based solely on polyethylene generally do not exhibit adequate oxygen barrier properties. Thus, additional barrier layers are added, often formed from an Ethylene vinyl alcohol (EVOH) material. Problematically, the inclusion of barrier layers can limit the recyclability of the overall pouch or the films associated with the pouch. On the other hand, if the amount of EVOH is minimized to a level at which recyclability is possible, it is often the case that the resulting film exhibits poor oxygen permeation.

SUMMARY OF THE DISCLOSURE

The disclosure is directed to a film for a pouch comprising a central layer, a first LLDPE tie layer, a second LLDPE tie layer, at least one outside HDPE layer, at least one inside HDPE layer and an inner LLDPE layer. The central layer comprises an EVOH, having an inside and an outside opposite the inside and a thickness. The first LLDPE tie layer is on the inside of the EVOH. The second LLDPE tie layer on the outside of the EVOH. The at least one outside HDPE layer is on an outside of the second LLDPE tie layer opposite the EVOH layer. The at least one inside HDPE layer is on an inside of the first LLDPE tie layer opposite the EVOH layer. The inner LLDPE layer is on an innermost one of the at least one inside HDPE layer. The inner LLDPE layer, first LLDPE tie layer and the at least one inside HDPE layer define an inside PE thickness. The second LLDPE tie layer and the at least one outside HDPE layer define an outside PE thickness. The inside PE thickness is at least twice the thickness of the outside PE thickness.

In some configurations, the central layer has a thickness of between 5 um and 10 um, and wherein the film defines an overall thickness that is between 110 um and 115 um.

In some configurations, the outside and the inside HDPE layers have a density that is greater than 0.94 g/cc.

In some configurations, the first and second LLDPE layers have a density that is less than 0.93 g/cc.

In some configurations, the inner LLDPE layer comprises the innermost layer of the film.

In some configurations, the inner LLDPE layer includes mPE.

In some configurations, the inner LLDPE layer comprises 53% LLDPE and 41% mPE.

In some configurations, the inner LLDPE layer further includes anti-block master-batch and polymer processing aid (PPA) master batch.

In some configurations, the thickness of the HDPE layers on the inside of the EVOH layer is greater than a thickness of the HDPE layers on the outside of EVOH layer.

In some configurations, the EVOH layer comprises a 29 mol % ethylene EVOH layer.

In some configurations, the film comprises a co-extrusion.

In another aspect of the disclosure, the disclosure is directed to a pouch assembly comprising a pouch and a spout. The pouch has at least two opposing walls that are sealed together to form a cavity. The spout is sealed to at least one of the opposing walls. The spout provides ingress into the cavity. The opposing walls are formed from the film set forth above and hereinbelow, with the inner LLDPE layer of a first one of the opposing walls sealed to the inner LLDPE layer of the second one of the opposing walls.

In some configurations, the spout is sealed to each of the opposing walls.

In some configurations, the pouch assembly further includes a gusset sealed to each of the opposing walls. The gusset is formed from the film set forth above and hereinbelow, with the inner LLDPE layer of the gusset sealed to each of the inner LLDPE layer of the first one of the opposing walls and the inner LLDPE layer of the second one of the opposing walls.

In some configurations, each of the at least two opposing walls defines a thickness. The thickness is between 110 um and 115 um, and more preferably, between 113 um and 114 um.

In some configurations, the EVOH layer comprises a 29 mol % ethylene EVOH having a thickness of between 5 um and 10 um.

BRIEF DESCRIPTION OF THE DRAWINGS

The disclosure will now be described with reference to the drawings wherein.

DETAILED DESCRIPTION OF THE DISCLOSURE

Figure 1:
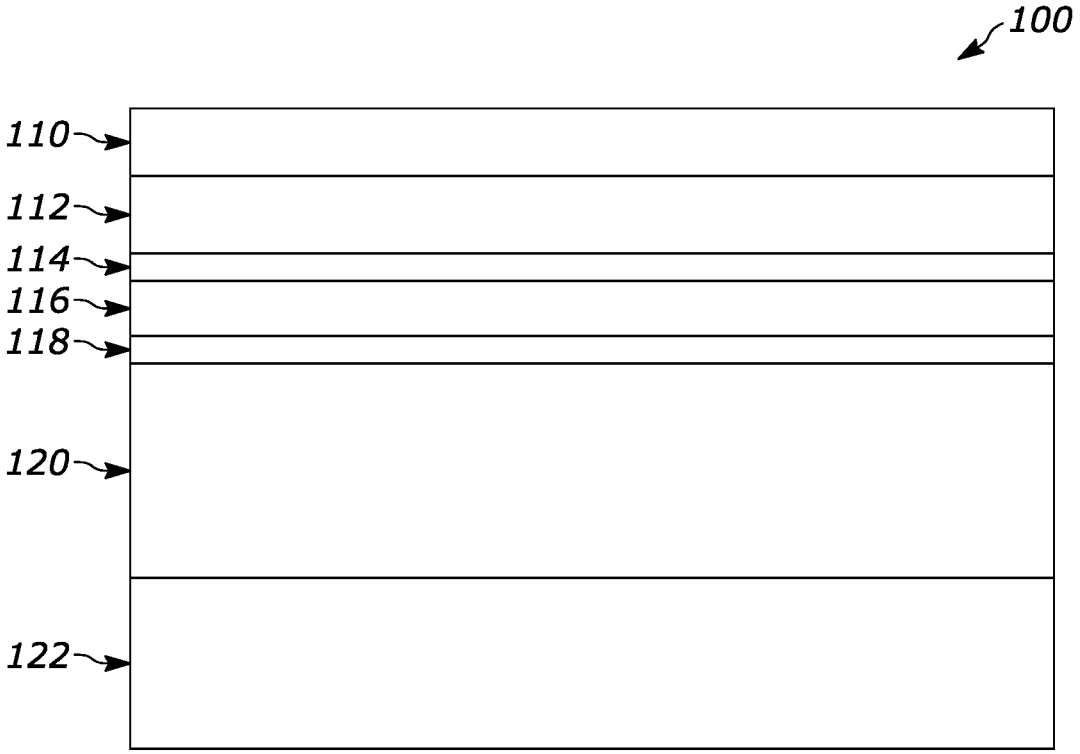
FIG. 1 of the drawings is a cross-sectional schematic representation of a configuration of the film of the present disclosure, showing in particular, the different layers thereof, while not being shown to scale.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the film for a pouch is shown generally at 100. The film is configured for use in the formation of a pouch assembly 10. Such a pouch assembly can be used to retain a flowable material, such as, infant and toddler foods, oils, dressings, sauces, humus, puddings, syrups, dairy based drinks, nutritional and sports drinks, among others (including non-foodstuffs as well as foodstuffs). It will be understood that the disclosure is not limited to any particular type of flowable material.

Figure 2:
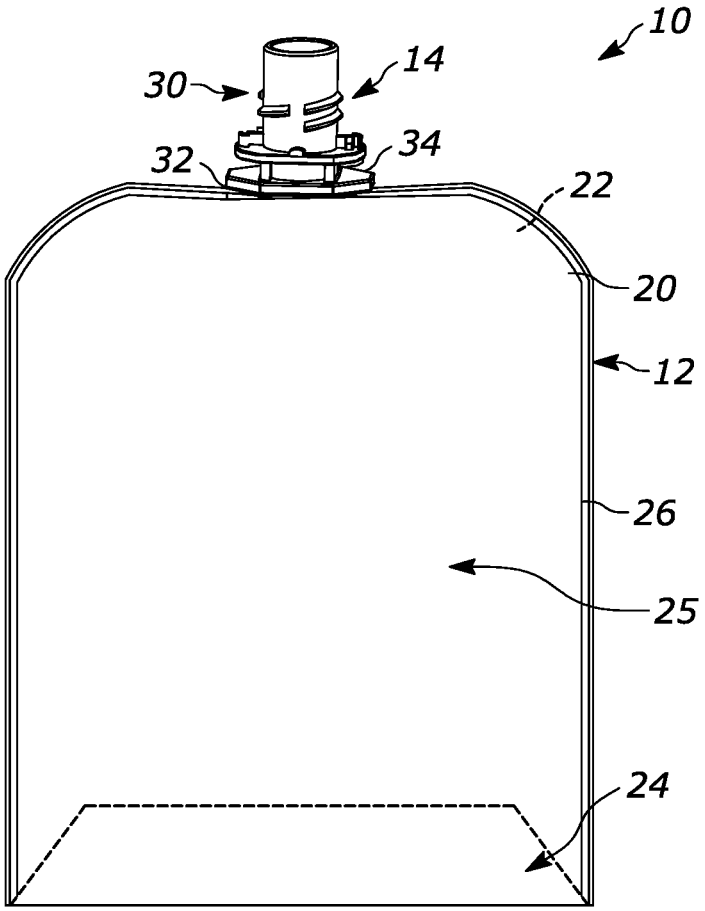
FIG. 2 of the drawings is a perspective view of a portion of the pouch assembly of the present disclosure having the film of the present disclosure.
Figure 3:
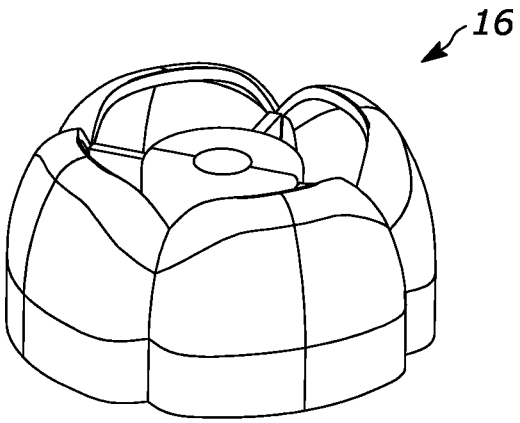
FIG. 3 of the drawings is a perspective view of a cap of the pouch assembly of the present disclosure used with the pouch assembly of FIG. 2.

The pouch assembly 10 is shown in FIGS. 2 and 3 as comprising pouch 12, spout 14 and cap 16. The pouch 12 generally comprises opposing walls 20, 22 and gusset portion 24. The opposing walls and the gusset portion are coupled together through seals, such as seals 26 which forms a cavity 25. The spout 14 is coupled to the pouch 12 and includes upper portion 30, lower portion 32, and guide channel 34 therebetween. The upper portion 30 is typically threaded, lower portion 32 is coupled to the pouch in a fluid tight engagement about a portion of seal 26, generally spaced apart from gusset portion 24. The cap 16 is configured to threadedly engage the upper portion about corresponding threads of the upper portion 30 of the spout 14.

The film 100 comprises a film that can be utilized to form the pouch 12 of the pouch assembly 10. Referring now to FIG. 1, in one configuration, the film 100 comprises a multi-layer extrusion formed, for example, from seven layers, namely, layers 110, 112, 114, 116, 118, 120, and 122. It will be understood that the outside of the pouch is defined by layer 110, with the inside of the pouch being defined by layer 122. It is contemplated that the overall film is between 45 and 180 um and, more preferably between 110 um and 115 um, and more preferably between 113 um and 114 um.

In the configuration shown, layer 110 comprises the outside layer in a formed pouch, such as pouch 12. The layer 110 comprises a HDPE layer, which may include other materials, such as an anti-block master batch and a PPA master batch. In one configuration, the layer comprises 98% HDPE, 1% anti-block master batch and 1% PPA master batch. The anti-block master batch may comprise 50% LDPE and 50% diatomaceous earth. The PPA master batch may comprise 98% LLDPE and 2% fluoropolymer based processing additive. Such additives may be used for a multitude of different properties, and other additives are contemplated. The particular additives are utilized to improve the characteristics for blown film production.

The layer 112 comprises a 100% HDPE layer. In certain configurations, such a layer may comprise a plurality of layers, each of which comprises an HDPE material. The layer 114 comprises a 100% LLDPE tie layer. The layer 116 comprises a 29 mol % ethylene EVOH material, and will be defined as the EVOH layer. The EVOH layer has an inside and an outside. The outside facing the layers on one side of the EVOH layer (i.e., the layers 110, 112 and 114). The inside facing the layers on the opposite side of the EVOH material (i.e., the layers 118, 120 and 122). As the EVOH layer comprises the central layer, as there are PE layers on either side thereof (one or more of LLDPE and HDPE). Preferably, the EVOH layer comprise one of 5 um and 10 um, while a range of between 3 um and 15 um are contemplated.

The layer 118 comprises a 100% LLDPE tie layer. Such a layer may comprise the same material as the layer 114. It will be understood that the tie layers improve the adhesion between the EVOH layer 116 and the HDPE layers on either side thereof.

The layer 120 comprises a 100% HDPE layer. Such a layer may be identical to or may be different from the layer 112. The layer 122 comprises 53% LLDPE/43% mPE/5% anti-block master-batch/1% PPA master-batch. The anti-block master-batch and the PPA master-batch may be similar to or identical to that set forth above with respect to the layer 110. The layer 122 represents the inner surface of the pouch 12 when formed, and thus is defined as the inner LLDPE layer.

In the configuration shown, the HDPE has a density which is greater than 0.94 g/cc, and, preferably approximately 0.962 g/cc. This may be utilized for layers 112 and 120. The LLDPE has a density which is less than 0.93 g/cc, and preferably approximately 0.921 g/cc. This may be utilized for each of the layers 114, 118 and 122. The mPE has a density which is less than 0.92 g/cc, and more preferably approximately 0.911 g/cc. The thickness of the EVOH layer is preferably between 3 um and 15 um. Additionally, the EVOH layer may be between 26 mol % and 48 mol % ethylene. The EVOH layer has a density 1.21 g/cc.

In the production of the film, it is contemplated that the thickness of the layers of PE (including the layers that are formed partially or completely from LLDPE and HDPE) on an inside of the EVOH layer 116 (i.e., layers 118, 120, and 122) are at least twice as thick as those on an outside of the EVOH layer 116 (i.e., layers 110, 112 and 114). In turn, the water vapor transmission rate WVTR on the inside of the EVOH is lower than that on the outside. Additionally, there is a greater thickness of the HDPE of layer 120 as compared to layer 110 and 112, that is a greater thickness of HDPE on the inside of the EVOH layer 116 as compared to the outside of the EVOH layer 116. Thus, as to both the thickness of the PE layer(s) and the thickness of HDPE, both are greater on the inside of the EVOH layer 116 as compared to the outside of the EVOH layer 118.

Two different examples were formed of films having the configuration in accordance with the present disclosure as set forth above. Each of the formulations were formed on a nine layer co-extruder. In such a configuration the HDPE layer 112 was split into two separate HDPE layers 112*a*, 112*b*. Similarly, the HDPE layer 120 was split into two separate HDPE layers 120*a*, 120*b*.

First Example Test Film

A first example test film was formed having the configuration generally shown in FIG. 1 wherein each layer has a thickness in micrometers (um) as set forth below, as well as the composition set forth below, and described above.

| LAYER | THICKNESS | MATERIAL |
|---|---|---|
| 110 outer | 12 | 98% HDPE/1% anti-block master-batch/ 1% PPA master-batch |
| 112a | 7 | 100% HDPE |
| 112b | 7 | 100% HDPE |
| 114 | 5 | 100% LLDPE tie |
| 116 | 10 | 100% 29 mol % ethylene EVOH |
| 118 | 5 | 100% LLDPE tie |
| 120a | 15 | 100% HDPE |
| 120b | 20 | 100% HDPE |
| 122 inner | 32 | 53% LLDPE/41% mPE/5% anti-block master-batch/1% PPA master-batch |

Second Example Test Film

A second example test film was formed having the configuration shown generally in FIG. 1 wherein each layer has a thickness in micrometers (um) as set forth below, as well as the composition set forth below, and described above.

| LAYER | THICKNESS | MATERIAL |
|---|---|---|
| 110 outer | 13 | 98% HDPE/1% anti-block master-batch/ 1% PPA master-batch |
| 112a | 8 | 100% HDPE |
| 112b | 8 | 100% HDPE |
| 114 | 5 | 100% LLDPE tie |
| 116 | 5 | 100% 29 mol % ethylene EVOH |
| 118 | 5 | 100% LLDPE tie |
| 120a | 16 | 100% HDPE |
| 120b | 22 | 100% HDPE |
| 122 inner | 32 | 53% LLDPE/41% mPE/5% anti-block master-batch/1% PPAmaster-batch |

In addition to the two example test films, two comparative examples were made having formulations that had similar amounts of PE on either side of the EVOH layer and that did not have more HDPE on an inside of the EVOH layer as compared to the outside of the EVOH Layer.

First Comparative Test Film

The first comparative test film was formed having a configuration that was analogous to the second example test film in total thickness and the thickness of the EVOH layer 116 (5 um).

| LAYER | THICKNESS | MATERIAL |
|---|---|---|
| 110 outer | 21 | 98% HDPE/1% anti-block master-batch/ 1% PPA master-batch |
| 112a | 14 | 100% HDPE |
| 112b | 14 | 100% HDPE |
| 114 | 5 | 100% LLDPE tie |
| 116 | 5 | 100% 29 mol % ethylene EVOH |
| 118 | 5 | 100% LLDPE tie |
| 120a | 11 | 100% HDPE |
| 120b | 19 | 59% LLDPE/41% mPE |

-continued

| LAYER | THICKNESS | MATERIAL |
|---|---|---|
| 122 inner | 19 | 53% LLDPE/41% mPE/5% anti-block master-batch/1% PPA master-batch |

Second Comparative Test Film

The second comparative test film was formed having a configuration that was analogous to the first example test film in total thickness (within 1 um) and the thickness of the EVOH layer 116 (10 um).

| LAYER | THICKNESS | MATERIAL |
|---|---|---|
| 110 outer | 21 | 98% HDPE/1% anti-block master-batch/ 1% PPA master-batch |
| 112a | 14 | 100% HDPE |
| 112b | 14 | 100% HDPE |
| 114 | 5 | 100% LLDPE tie |
| 116 | 10 | 100% 29 mol % ethylene EVOH |
| 118 | 5 | 100% LLDPE tie |
| 120a | 12 | 100% HDPE |
| 120b | 16 | 59% LLDPE/41% mPE |
| 122 inner | 16 | 53% LLDPE/41% mPE/5% anti-block master-batch/1% PPA master-batch |

The samples were created and tested with respect to oxygen transmission rates. In particular, a pouch was formed from each of the above example test films and comparative test films. The test conditions are as follows:

| Test Conditions | |
|---|---|
| % RH Carrier Gas (Nitrogen) - inside: | 90 |
| % RH Test Gas (Oxygen) - outside: | 50 |
| Machine Temp: | 23 C. |

The oxygen transmission rate was checked on a monthly basis over at least a period of 5 months, and for some films 12 months.

The graph below shows the oxygen transmission rate each month of storage, as well as the average for pouches formed from each of the comparative films in cc 100% O2/m2/day.

| | Storage Time (Months) | | | | | | | | | | | | | |
|---|---|---|---|---|---|---|---|---|---|---|---|---|---|---|
| | 0 | 1 | 2 | 3 | 4 | 5 | 6 | 7 | 8 | 9 | 10 | 11 | 12 | Ave |
| First Example Test Film | 0.45 | 0.70 | 0.55 | 0.57 | 0.61 | 0.73 | | | | | | | | 0.60 |
| First Comparative Test Film | 1.23 | 1.12 | 1.05 | 1.32 | 1.30 | 1.26 | 1.49 | 1.66 | 1.75 | 1.67 | 0.93 | 1.56 | 1.59 | 1.38 |
| Second Example Test Film | 0.37 | 0.41 | 0.56 | 0.40 | 0.38 | 0.38 | 0.36 | 0.41 | 0.17 | 0.49 | 0.43 | | | 0.40 |
| Second Comparative Test Film | 0.91 | 0.72 | 1.15 | 1.49 | 1.37 | 1.48 | 1.04 | 1.13 | 0.87 | 0.86 | 0.91 | 1.08 | 1.00 | 1.08 |

As can be seen from the chart above, the second example test film performed substantially better than the second comparative test film despite being of the substantially the same thickness and having substantially the same thickness of the EVOH layer 116. In fact, the oxygen transmission rate of the second example test film is less than 38% that of the second comparative test film.

Similarly, the first example test film performed substantially better than the first comparative test film despite being substantially the same thickness and having substantially the same thickness of the EVOH layer 116. In fact, the oxygen transmission rate of the first example test film is less than 43% of that of the first comparative test film.

Figure 4:
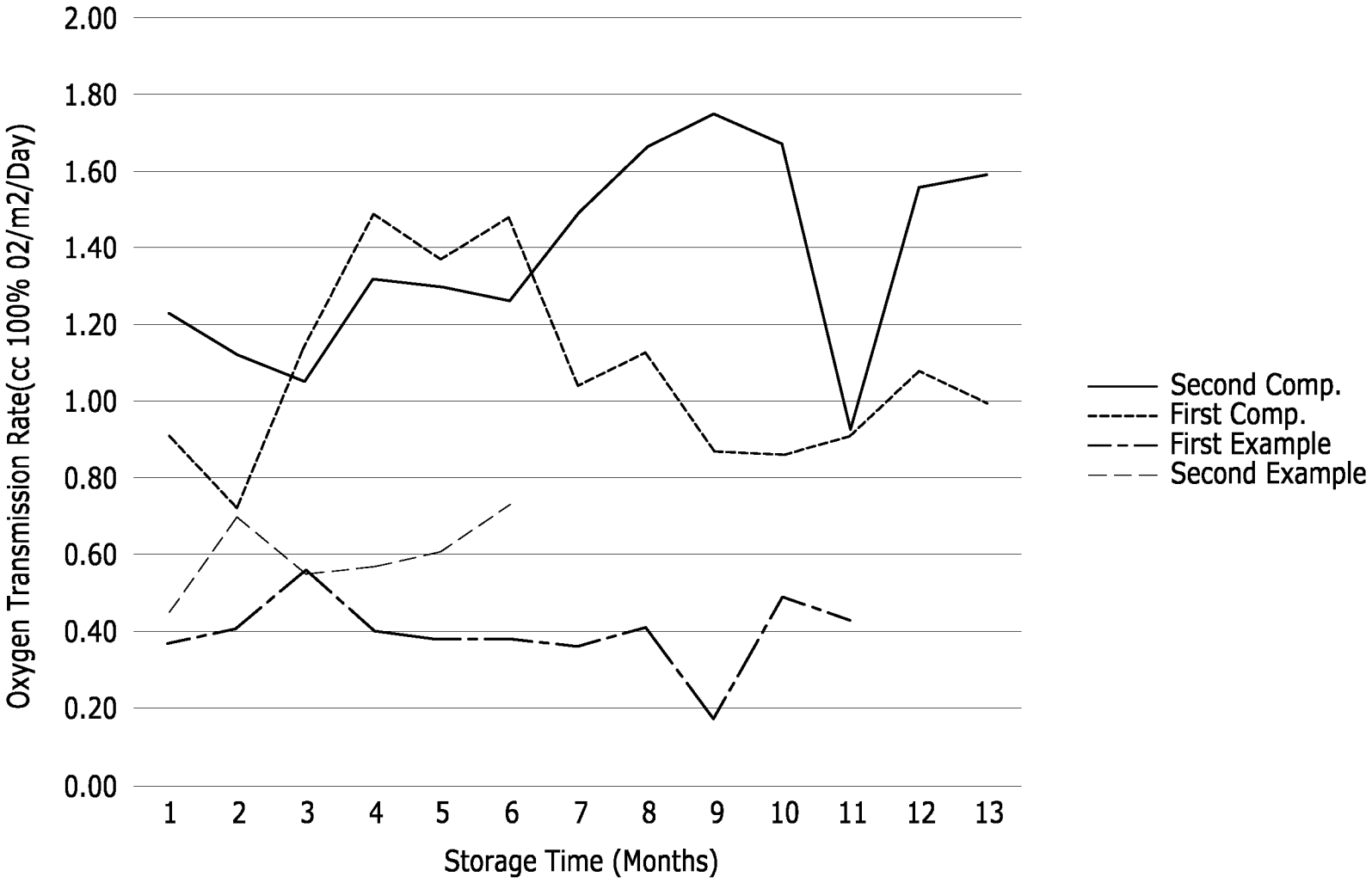
FIG. 4 of the drawings is a graphical representation of the oxygen transmission rates of the various example films and comparative films, showing the results thereof.

A graph showing the results set forth above is shown in FIG. 4.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A unitary co-extruded film for a pouch comprising:

a central layer comprising an EVOH, having an inside and an outside opposite the inside and a thickness;

a first LLDPE tie layer directly in contact with the inside of the EVOH and a second LLDPE tie layer directly in contact with the outside of the EVOH;

at least one outside HDPE layer directly in contact with an outside of the second LLDPE tie layer opposite the EVOH layer;

at least one inside HDPE layer directly in contact with an inside of the first LLDPE tie layer opposite the EVOH layer; and an inner LLDPE layer directly in contact with an innermost one of the at least one inside HDPE layer, wherein the inner LLDPE layer, first LLDPE tie layer and the at least one inside HDPE layer define an inside PE thickness and wherein the second LLDPE tie layer and the at least one outside HDPE layer define an outside PE thickness, with the inside PE thickness being at least twice the thickness of the outside PE thickness.

2. The film for a pouch of claim 1 wherein the central layer has a thickness of between 5 um and 10 um, and wherein the film defines an overall thickness that is between 110 um and 115 um.

3. The film for a pouch of claim 1 wherein the outside and the inside HDPE layers have a density that is greater than 0.94 g/cc.

4. The film for a pouch of claim 1 wherein the first and second LLDPE layers have a density that is less than 0.93 g/cc.

5. The film for a pouch of claim 1 wherein the inner LLDPE layer comprises the innermost layer of the film.

6. The film for a pouch of claim 5 wherein the inner LLDPE layer includes metallocene polyethylene.

7. The film for a pouch of claim 6 wherein the inner LLDPE layer comprises 53% LLDPE by weight and 41% metallocene polyethylene by weight.

8. The film for a pouch of claim 7 wherein the inner LLDPE layer further includes anti-block master-batch and PPA master batch.

9. The film for a pouch of claim 1 wherein the thickness of the HDPE layers on the inside of the EVOH layer is greater than a thickness of the HDPE layers on the outside of EVOH layer.

10. The film for a pouch of claim 1 wherein the EVOH layer comprises a 29 mol % ethylene EVOH layer.

11. A pouch assembly comprising:

pouch having at least two opposing walls that are sealed together to form a cavity;

a spout sealed to at least one of the opposing walls, the spout providing ingress into the cavity, wherein the opposing walls are formed from the film of claim 1, with the inner LLDPE layer of a first one of the opposing walls sealed to the inner LLDPE layer of the second one of the opposing walls.

12. The pouch assembly of claim 11 wherein the spout is sealed to each of the opposing walls.

13. The pouch assembly of claim 11 further comprising a gusset sealed to each of the opposing walls, with the inner LLDPE layer of the gusset sealed to each of the inner LLDPE layer of the first one of the opposing walls and the inner LLDPE layer of the second one of the opposing walls wherein the gusset and opposing walls of the pouch assembly are formed of identical film composition and structure.

14. The pouch assembly of claim 11 wherein each of the at least two opposing walls defines a thickness, with the thickness being between 110 μm and 115 μm, and more preferably, between 113 μm and 114 μm.

15. The pouch assembly of claim 14 wherein the EVOH layer comprises a 29 mol % ethylene EVOH having a thickness of between 5 μm and 10 μm.

16. The film for a pouch of claim 1 wherein the film has an oxygen transmission rate of less than 0.8 $cc/m^2/day$ at 90% RH carrier gas (Nitrogen) on the inside of the film and 50% RH test gas (Oxygen) on the outside of the film at 23° C.

* * * * *